US005501626A

United States Patent [19]

Harvey

[11] Patent Number: 5,501,626

[45] Date of Patent: Mar. 26, 1996

[54] POLYGONAL ELEMENT FOR CONSTRUCTING POLYHEDRAL STRUCTURES IN THE FORM OF A FLEXIBLE PERIPHERAL FRAME

[76] Inventor: Edward H. Harvey, 3 Church End Cottages, Bletchingdon, Oxford, United Kingdom

[21] Appl. No.: 423,027

[22] Filed: Apr. 17, 1995

[30] Foreign Application Priority Data

Oct. 20, 1994 [GB] United Kingdom ..... 9421165

[51] Int. Cl.[6] ..... A63H 33/08

[52] U.S. Cl. ..... 446/104; 446/107; 446/115; 446/125

[58] Field of Search ..... 446/102, 104, 446/106, 107, 108, 115, 116, 120, 121, 125, 124

[56] References Cited

U.S. PATENT DOCUMENTS

| | | | |
|---|---|---|---|
| 3,782,029 | 1/1974 | Bardot | 446/102 X |
| 4,055,019 | 10/1977 | Harvey | 446/104 |
| 4,309,852 | 1/1982 | Stolpin | 446/116 X |
| 4,792,319 | 12/1988 | Svagerko | 446/104 |
| 4,886,477 | 12/1989 | Ziegler . | |
| 5,183,430 | 2/1993 | Swann | 446/104 |

FOREIGN PATENT DOCUMENTS

| | | | |
|---|---|---|---|
| 546535 | 9/1957 | Canada | 446/116 |
| 0109181 | 5/1984 | European Pat. Off. | 446/104 |
| 2534484 | 4/1984 | France | 446/104 |

*Primary Examiner*—Mickey Yu
*Assistant Examiner*—D. Neal Muir
*Attorney, Agent, or Firm*—Edward A. Sokolski

[57] ABSTRACT

A polygonal element is provided for forming polyhedral structures, particularly for use as an educational constructional toy. The polygonal element has side margins each comprising an inner edge, an outer edge, first and second projections extending outwardly of the outer edge and a recess defined by the first and second projections. The first projection comprises a pair of spaced limbs unconnected at their outer ends. The side face of the recess defined by an inner limb of the first projection is an abutment face. One of the side faces of the recess opposite the abutment face and the outer side face of the outer of said limbs is provided with a projecting hinge pip and the other with a corresponding hinge socket. The arrangement is such that when the polygonal element is hingedly connected edge-to-edge with another such element by inserting the first projection of a side margin of each element in the recess of the other so that the abutment faces thereof abut, the pressure exerted on the outer side faces of the limbs will produce sufficient bowing or the side margins to enable the hinge pip of each side margin to spring into the hinge socket of the other side margin.

12 Claims, 5 Drawing Sheets

POLYGONAL ELEMENT FOR CONSTRUCTING POLYHEDRAL STRUCTURES IN THE FORM OF A FLEXIBLE PERIPHERAL FRAME

FIELD OF THE INVENTION

The invention relates to a polygonal element for forming polyhedral structures by hingedly connecting together a plurality of such elements in edge-to-edge relationship, such polygonal elements being particularly useful as an educational constructional toy.

BACKGROUND OF THE INVENTION

In my U.S. Pat. No. 4,055,019 there is described and claimed a planar element for use as part of a constructional toy comprising a plurality of such elements. The planar element has at least one side margin comprising first and second spaced projections which define therebetween a recess, that side face of the recess defined by an inner side face of said first projection being an abutment face, one of the side face: of the recess opposite the abutment face and the outer side face of the first projection being provided with a hinge socket and the other said face with a corresponding hinge pip, and a slot in said first or second projection extending inwardly from the outer edge of the projection to form a resilient spring at one side of said recess, the arrangement being such that when two such elements are connected together by inserting the first projection of each element in the recess of the other element said springs will provide sufficient resilience to enable the hinge pip of each element to be sprung into the hinge socket of the other element to thereby hingedly connect the elements together.

Constructional toys comprising a plurality of planar elements according to my said Patent are sold under the Registered Trademark "Polydron" and have been commercially successful, particularly in the field of education. However, it has become apparent that there is a need for a version of such a constructional toy wherein the planar elements comprise simply an outer peripheral frame with no material in the centre thereof so that when a plurality of such elements are hingedly connected together edge-to-edge to form a polyhedral structure not only the outside but also the inside of the polyhedral structure can be examined. Whilst planar elements comprising simply an outer peripheral frame were contemplated in my aforesaid Patent, if it is desired to provide such an element wherein the outer peripheral frame is relatively narrow, and therefor aesthetically more pleasing, then the provision of a said inwardly extending slot to provide said resilient spring in each if the margins of the planar element becomes impractical because it so weakens the element that it is liable to break in use.

OBJECT OF THE INVENTION it is an object of the invention to provide a polygonal element for forming polyhedral structures by hingedly connecting together a plurality of such elements in edge-to-edge relationship, wherein the connecting means is such as to obviate the need for an inwardly extending slot and the resilient spring defined thereby.

It is also an object of the present invention to provide a polygonal element for forming polyhedral structures by hingedly connecting together a plurality of such elements in edge-to-edge relationship which, if desired, can be compatible with and hingedly connect in edge-to-edge relationship with the known planar elements sold under the Registered Trademark "Polydron".

SUMMARY OF THE INVENTION

The present invention provides a polygonal element for forming polyhedral structures by hingedly connecting together a plurality of such elements in edge-to-edge relationship, wherein each side margin of the polygonal element comprises:

(a) inner edge and an outer edge, b) first and second projections extending outwardly of the outer edge and defining therebetween a recess, c) said first projection consisting of a pair of spaced limbs extending outwardly of the outer edge and unconnected at their outer ends, the distance between the outer side faces of said limbs being substantially the same as the length of said recess, d) the side face of said recess defined by an inner limb of said first projection being an abutment face, and e) one of the side faces of said recess opposite said abutment face and the outer side face of the outer of said limbs being provided with a projecting hinge pip and the other with a hinge socket, whereby when the polygonal element is hingedly connected edge-to-edge with another such element by inserting said first projection of a margin of each element in the recess of the margin of the other element so that the abutment faces thereof abut, the pressure exerted on the outer side faces of the limbs of the first projection of each element will produce sufficient bowing of the side margin of the element to enable the hinge pip of each side margin to be sprung into the hinge socket of the other side margin.

DETAILED DESCRIPTION OF THE DRAWINGS

Figure 1:
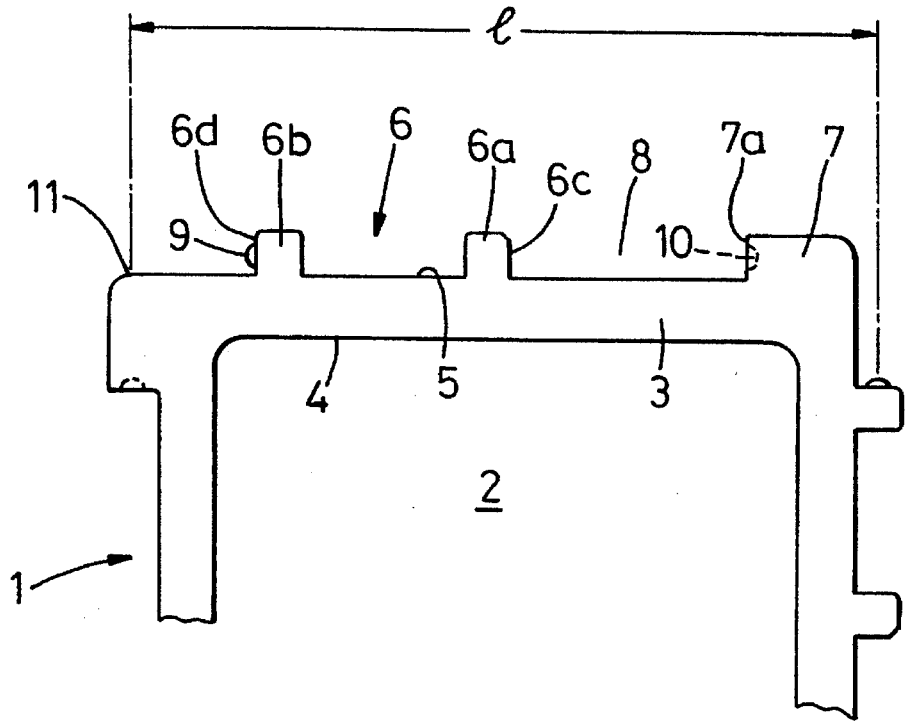
FIG. 1 is a fragmentary plan view illustrating one side margin of a substantially square polygonal element according to a first embodiment of the present invention.

Referring now to FIG. 1 it will be seen that the polygonal element 1 illustrated therein is substantially square and has an aperture 2 in the centre thereof which is also square, whereby the polygonal element 1 is in the form of a frame. As a result, each side margin 3 of the polygonal element has an inner edge 4 and an outer edge 5. Extending outwardly of the outer edge 5 are a first projection 6 and a second projection 7 which define between them a recess 8. The first projection 6 consists of a pair of spaced limbs *6a, 6b* which are unconnected at their outer ends. The distance between the outer side faces *6c, 6d* of the limbs *6a, 6b* respectively is substantially the same as the length of the recess 8. The outer side face *6c* of limb *6a* forms one side face of the recess 8 and is an abutment face.

Outer side face *6d* of the limb *6b* has a projecting part-spherical hinge pip 9 thereon whilst the inner side face *7a* of second projection 7 has a corresponding part-spherical hinge socket 10 therein.

Outer limb *6b* of the first projection 6 also defines an open-ended recess 11.

When the side margin 3 of polygonal element 1 is hingedly connected edge-to-edge with a similar side margin of another such polygonal element by inserting the first projection 6 of each side margin in the recess 8 of the other side margin so that the abutment faces *6c* of the two side margins abut, the pressure exerted on the outer side faces *6c, 6d* of the limbs *6a, 6b* respectively produces sufficient bowing of the side margins 3 to enable the hinge pip 9 of each side margin to be sprung into the hinge socket 10 of the other side margin.

Figure 2:
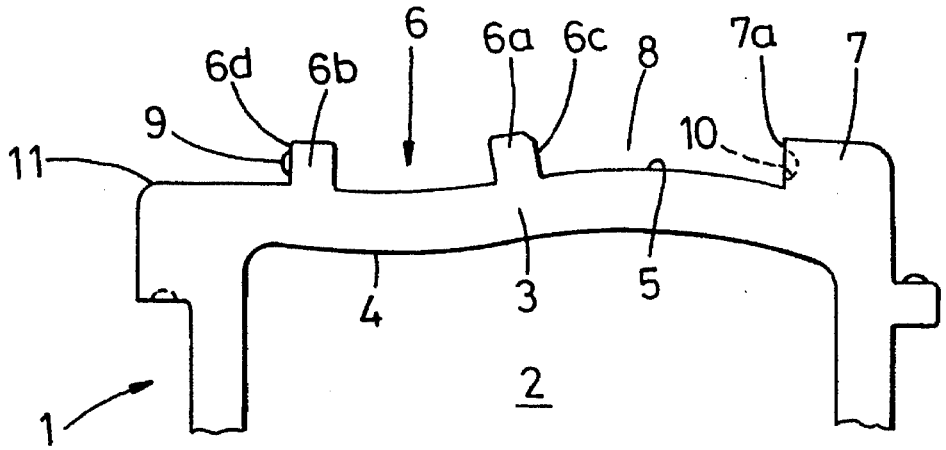
FIG. 2 is a view similar to FIG. 1 and illustrating the bowing of the side margin which occurs during the connection edge-to-edge of the side margin of the polygonal element of FIG. 1 with a corresponding side margin of another such element, said bowing of the side margin being exaggerated for the sake of clarity.

Although very much exaggerated for the sake of clarity, it will be seen from FIG. 2 that the said pressure exerted on the outer side faces *6c, 6d* of the limbs *6a, 6b* of each of the side margins 3 during said connection causes the outer ends of the limbs *6a, 6b* to move towards one another, which movement is permitted by the outer ends of the limbs *6a, 6b* being unconnected, and this in turn causes the side margin 3 to bow in a serpentine manner in the plane of the polygonal element 1. Accordingly the outer edge 5 of the side margin 3 becomes slightly concave in the region of the side limbs *6a, 6b* of the first projection 6 and slightly convex in the region of the recess 8. As a result, the distance between the outer ends of the outer side faces *6c, 6d* of the projection 6 is slightly reduced whilst the distance between the outer ends of the side faces *6c, 7a* of the recess 8 is slightly increased, so enabling the hinge pip 9 of each side margin 3 to be sprung into the hinge socket 10 of the other side margin.

In effect, the side margin 3 acts as a beam and the limbs *6a, 6b* as levers which produce bending moments in the beam when force is applied to the outer side faces *6c, 6d* thereof. It is accordingly a fairly simple matter to determine the width of beam, i.e. the distance between the inner and outer edges 4, 5 of the side margin 3, required for any particular combination of geometric or modular hinge length 1 (FIG. 1), thickness of the polygonal element 1, offset i.e. distance between the longitudinal axis of the beam and the hinge axis, and the material from which the polygonal element 1 is formed, If desired, the beam width can vary over different parts of the length thereof to provide required bending moments in different parts of the beam.

In the illustrated embodiment, the polygonal element is formed from ABS (AcrylonitrileButadieneStyrene), the modular or geometric hinge length is 70 mm., the thickness of the polygonal element is 3.2 mm., the offset is about 5 mm., the width of the limbs *6a, 6b* is 4 mm. and the width of the beam is about 5 mm. The distance between the outer side faces *6c, 6d* of first projection 6 is 22.75 mm. and the length of the recess 8 is 22.25 mm. With these dimensions the polygonal element 1 is compatible with and hingedly connectable to the known planar elements sold under the Registered Trademark "Polydron".

Except for minor differences to be described, the embodiments shown in FIGS. 3 to 7 are the same as the embodiment of FIGS. 1 and 2 and accordingly the same reference numerals have been used for the same parts.

Figure 3:
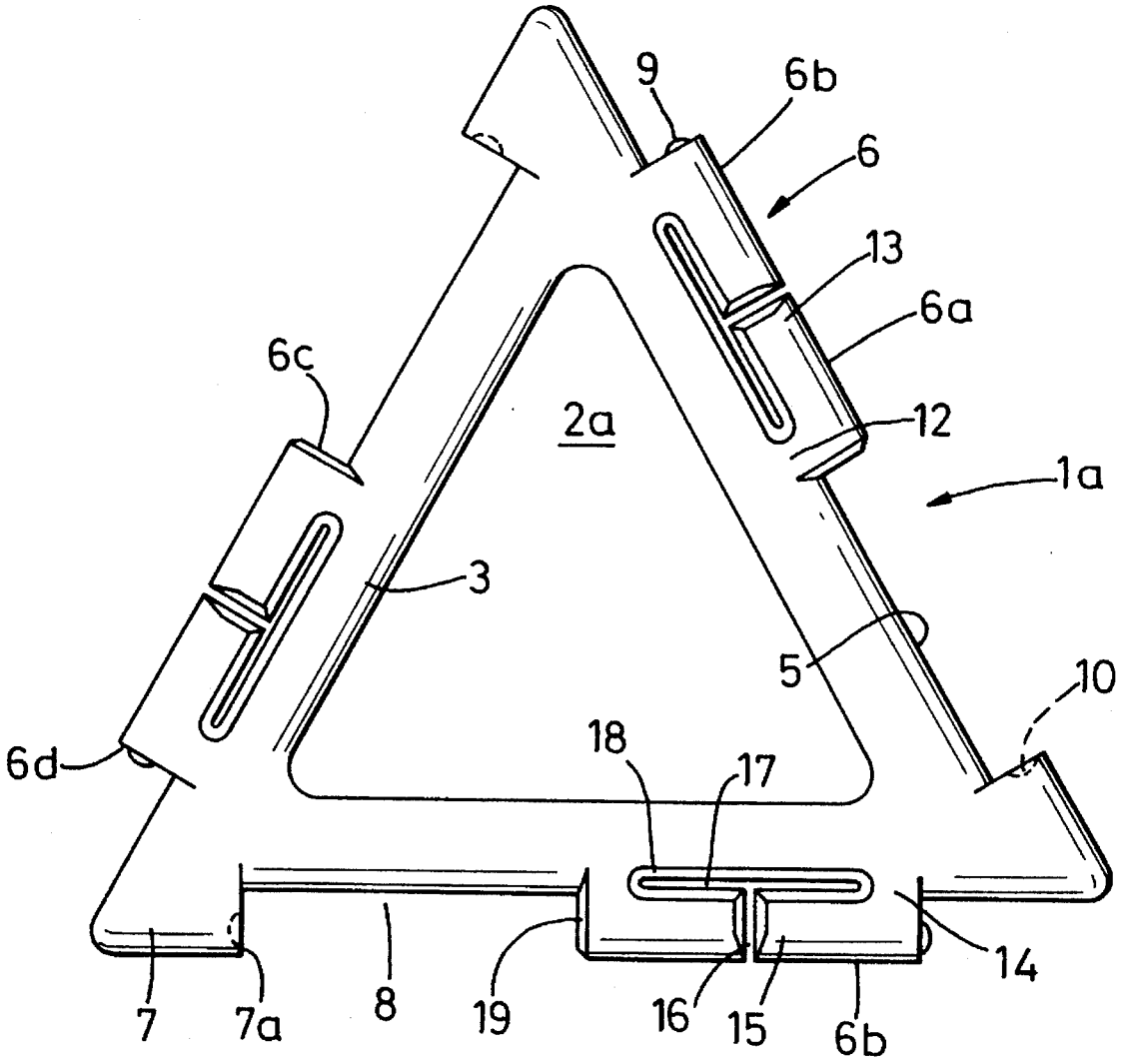
FIG. 3 is a plan view of a polygonal element according to a preferred embodiment of the present invention, the polygonal element being substantially in the form of an equilateral triangle.
Figure 4:
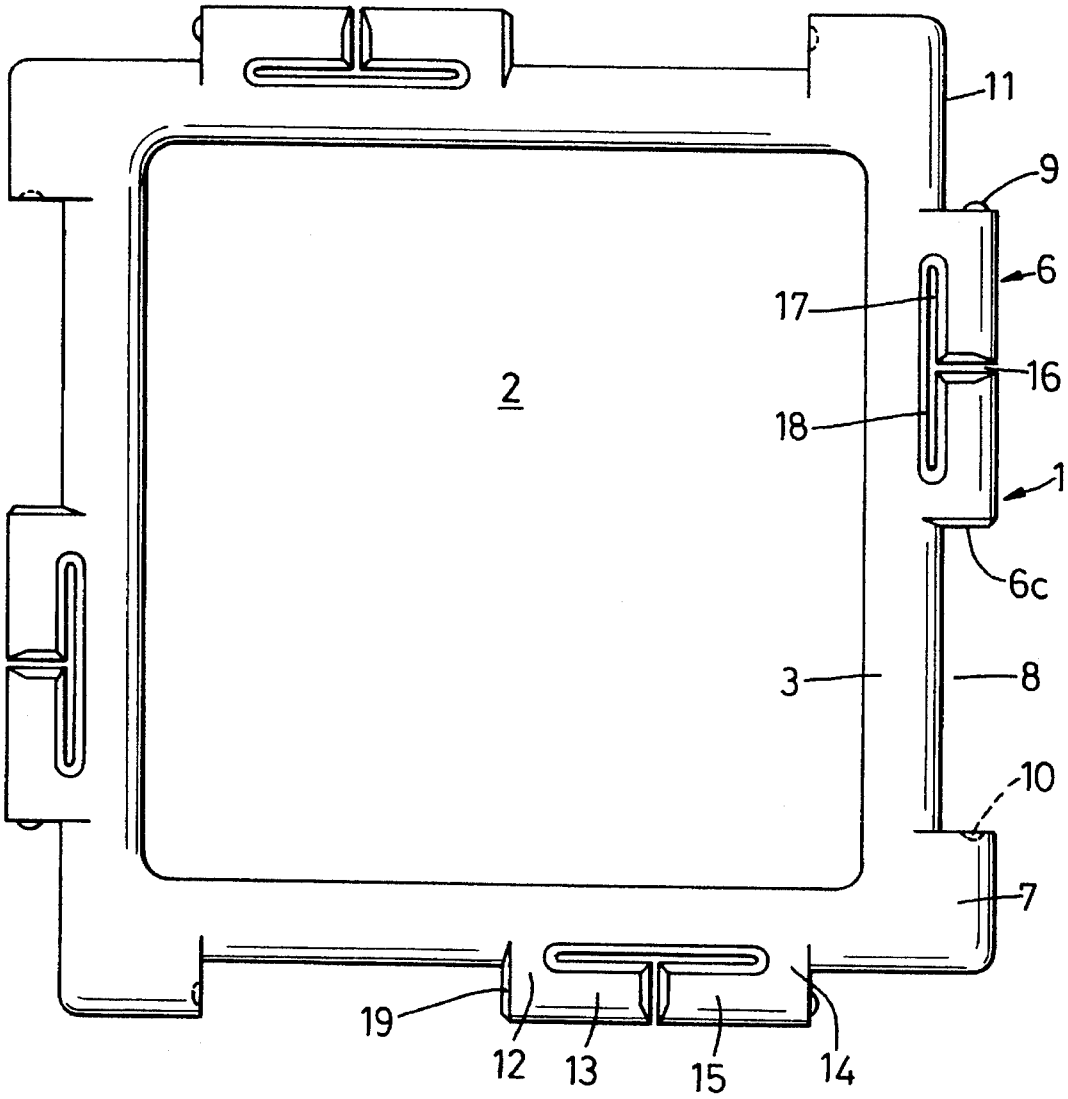
FIG. 4 is a plan view of a substantially square polygonal element according to said preferred embodiment of the present invention.
Figure 5:
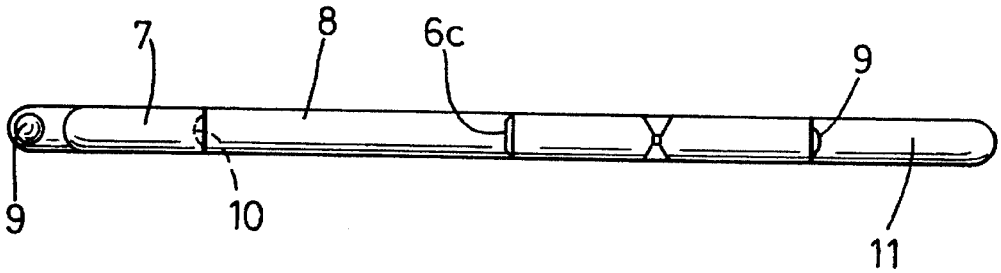
FIG. 5 is a side view of one side margin of a polygonal element according to FIG. 3 or 4, FIGS. 6A and 6B are enlarged fragmentary views showing respectively the hinge socket and hinge pip of the side margin of FIG. 5.
Figure 6A:
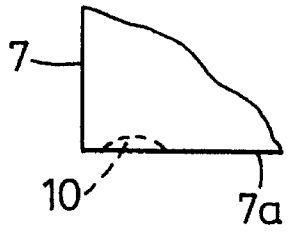
Figure 6B:
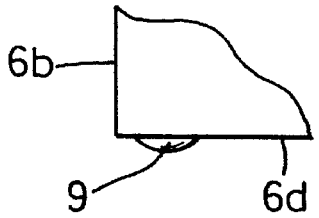

It will be seen from FIG. 3 that the polygonal element *1a* shown therein is in the form of an equilateral triangle is the central aperture *2a*.

Figure 7:
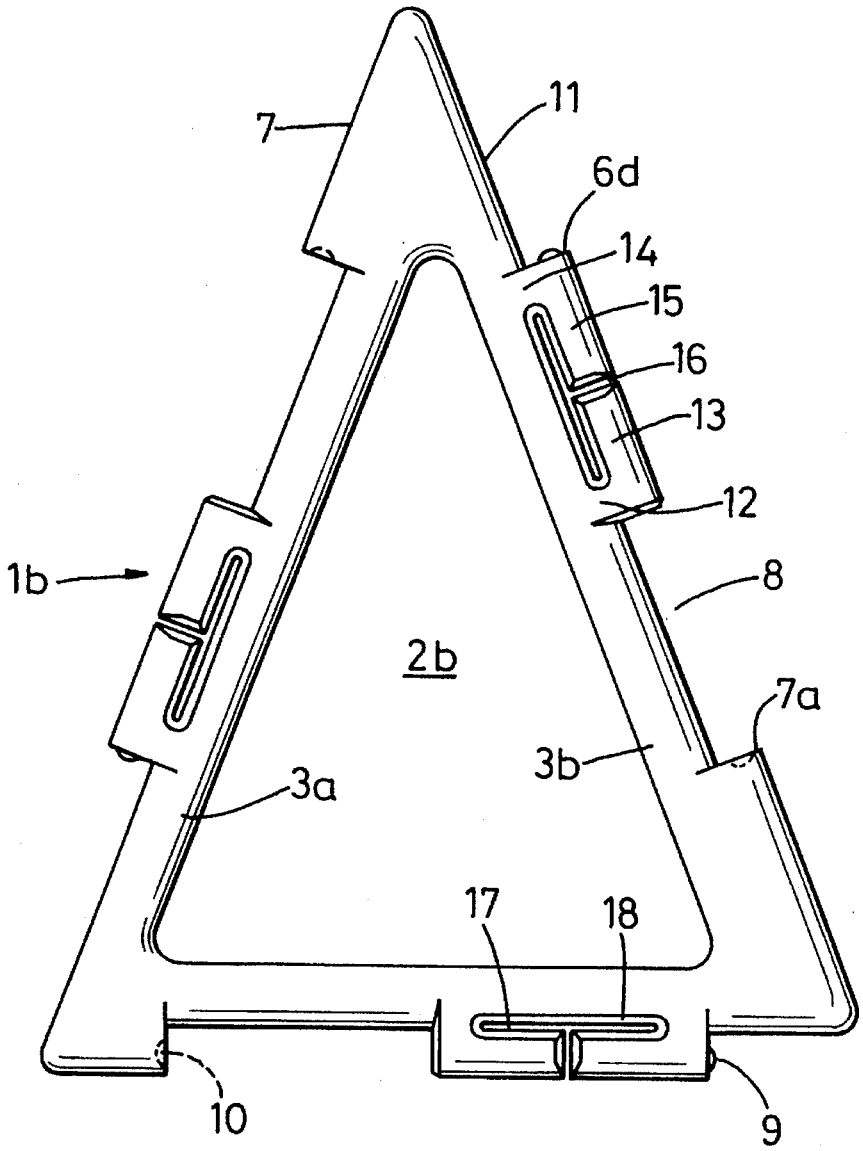
FIG. 7 is a plan view of another polygonal element according to said preferred embodiment, the polygonal element in this case being in the form of an isosceles triangle.

Likewise it will be seen from FIG. 7 that the polygonal element *1b* shown therein is in the form of an isosceles triangle as is the central aperture *2b*. Although in this embodiment the overall length of the opposite side margins *3a, 3b* is greater than in the embodiments of FIGS. 1 to 6, it will be understood that this extra length is accommodated by increasing the length of both the second projection 7 and the open-ended recess 11. The actual hinge length between the side faces *6d* and *7a* is the same as in the other embodiments and accordingly the side margins *3a, 3b* are compatible with and hingedly connectable to the side margins of the embodiments of FIGS. 1 to 6.

In the embodiments of FIGS. 3 to 7, the first projection of each side margin 3 comprises limbs *6a, 6b*, the limb *6a* having a first leg 12 extending outwardly of the outer edge 5 and a second leg 13 at right angles to the first leg 12 and extending towards the limb *6b*. Likewise the limb *6b* has a first leg 14 extending outwardly of the outer edge 5 and a second leg 15 at right angles to the first leg 14 and extending towards the limb *6a*. The adjacent free ends of the second legs 13, 15 are separated by a gap 16. The size of the gap 16 may be so chosen that the second legs 13, 15 will act as stops to limit said bowing of the side margin 3 during connection of the side margin 3 with a compatible side margin of another such polygonal element. The edges of the second legs 13, 15 on either side of the gap 16 and the edges of the slot 17 defined between the outer edge 5 and the second legs 13, 15 may be chamferred as shown at 18. It will also be seen from FIGS. 3 to 7 that the width of each side margin 3 in the region of the slot 17 is less than in the region of the recess 8. This is to compensate for the fact that the slot 17 is shorter in length than the recess 8 and to ensure that the side margin 3 will bow as required during connection of the side margin 3 with a compatible side margin of another such element.

The advantage of forming the first projection 6 of each side margin 3 in the manner shown in FIGS. 3 to 7 is that the polygonal elements are more aesthetically pleasing and more closely resemble in appearance the known planar elements sold under the Registered Trademark "Polydron", with which they are preferably compatible.

Also in the embodiments of FIGS. 3 to 7 the edges of the abutment face 6c of each side margin 3 are chamferred as shown at 19 to facilitate the connection of the side margin 3 with a compatible side margin of another such polygonal element.

Figure 8:
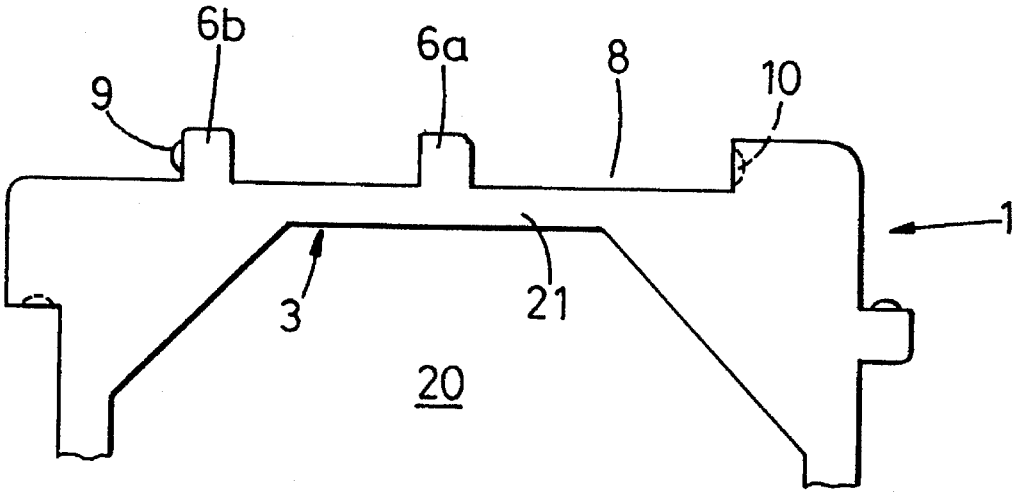
FIG. 8 is a fragmentary plan view of a substantially square polygonal element according to another embodiment of the present invention.

The embodiment shown in FIG. 8 is similar to that shown in FIG. 1 except that the central aperture 20 is octagonal in shape. As this limits the length of that part 21 of each side margin 3 of the element which can bow during connection with another such polygonal element, the width of the part 21 is reduced as compared with the previous embodiments.

Figure 9:
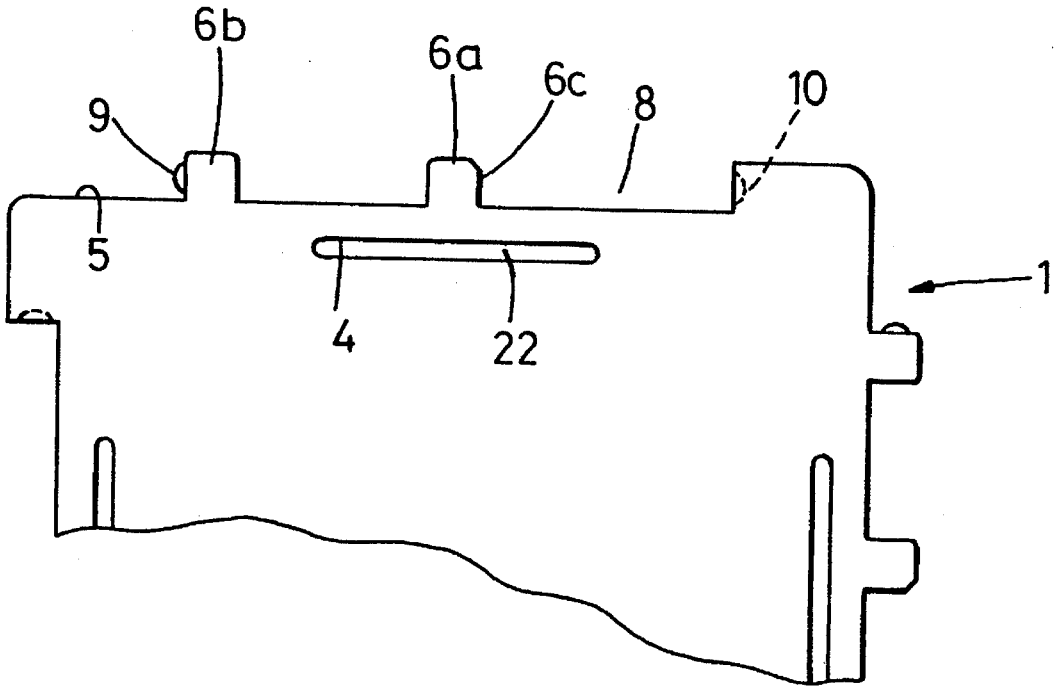
FIG. 9 is a fragmentary plan view of a substantially square polygonal element according to yet another embodiment of the present invention.

The embodiment shown in FIG. 9 is again similar to that of FIG. 1 except that in this embodiment the central aperture 2 is omitted and the inner edge 4 of each side margin 3 is defined by a slot 22 which extends over at least the region of the abutment face 6c and which may extend over the greater part of the side margin.

The present invention also includes larger polygonal elements having at least one side margin which is a multiple of a said side margin 3 and comprises at least two such hinge connections whereby at least two polygonal elements 1 may be hingedly connected thereto.

I claim:

1. A polygonal element for forming polyhederal structures by hingedly connecting together a plurality of such elements in edge-to-edge relationship, wherein each side margin of the polygonal element comprises:

(a) an inner edge and an outer edge, (b) first and second projections extending outwardly of the outer edge and defining therebetween a recess, (c) said first projection consisting of a pair of spaced limbs extending outwardly of the outer edge and unconnected at their ends, said limbs each having an outer side face, the outer side faces of said limbs being spaced apart a distance which is substantially the same as the length of said recess, (d) the outer face of that limb adjacent said second projection defining a first side face of said recess and forming an abutment face, (e) a second side face of said recess opposite said abutment face formed on said second projection and having a hinge socket formed therein, and an outer side face of the distal of said limbs being provided with a projecting hinge pip, whereby when the polygonal element is hingedly connected edge-to-edge with another such element by inserting said first projection of a side margin of each element in the recess of the side margin of the other element so that the abutment faces thereof abut, pressure will be exerted on the outer side faces of the limbs of the first projection of each element to produce sufficient bowing of the side margin of each element to enable the hinge pip of each side margin to be sprung into the hinge socket of the other side margin of the other element.

2. A polygonal element according to claim 1, having a polygonal aperture therein of the same polygonal shape as the polygonal element so that the polygonal element is in the form of a frame.

3. A polygonal element according to claim 1, having a slot therein extending parallel with each said side margin and defining the inner edge of the side margin.

4. A polygonal element according to claim 1, wherein each side margin has the hinge socket in that side face of the recess opposite the abutment face and the hinge pip is on the outer side face of the outer limb of said first projection.

5. A polygonal element according to claim 1, wherein each limb of said first projection of each side margin comprises a first leg extending outwardly of said outer edge and a second leg at right angles thereto and extending towards the other of said limbs.

6. A polygonal element according to claim 5, wherein said second legs of said first projection serve as stops to limit bowing of the side margin on which the first projection is provided.

7. A polygonal element according to claim 1, wherein the side margins of the polygonal element lie in a common plane and said bowing of the side margin of the element during said connection occurs solely within said plane.

8. A polygonal element according to claim 7, wherein said bowing of the side margin of the element during said connection is such that the said outer edge becomes slightly concave in the region of said first projection.

9. A polygonal element according to claim 7, wherein said bowing of the side margin of the element during said connection is such that the said outer edge becomes slightly convex in the region of said recess.

10. A polygonal element according to claim 7, wherein said side margin assumes a serpentine shape during said connection.

11. A polygonal element according to claim 1, wherein the edges of said abutment face are chamferred to assist said connection.

12. A polygonal element for forming polyhedral structures by hingedly connecting together a plurality of such elements in edge-to-edge relationship, the polygonal element having a polygonal aperture therein of the same polygonal shape as the polygonal element whereby the polygonal element is in the form of a frame, wherein each side margin of the polygonal element comprises:

(a) an inner edge and an outer edge, (b) first and second projections extending outwardly of the outer edge and defining therebetween a recess, (c) said first projection consisting of a pair of spaced limbs extending outwardly of the outer edge and unconnected at their outer ends, said limbs each having an outer side face, the outer side faces of said limbs being spaced apart a distance which is substantially the same as the length of said recess, (d) each limb of said first projection comprising a first leg extending outwardly of said outer edge and a second leg at right angles to the first leg and extending towards the other of said limbs, said second legs having adjacent free ends separated by a gap, (e) the outer face of that limb adjacent said recess defining a first side face of said recess and forming an abutment face, and (f) a second side face of said recess opposite said abutment face defined by said second projection and having a hinge socket formed therein, an outer side face of the distal of said limbs being provided with a projecting hinge pip, whereby when the polygonal element is hingedly connected edge-to-edge with another such element by inserting said first projection of a side margin of each element in the recess of the side margin of the other element so that the abutment faces thereof abut, pressure will be exerted on the outer side faces of the limbs of the first projection of each element to cause the side margin of the element to bow in a serpentine manner in a plain containing the polygonal element such that the outer edge of the side margin becomes slightly concave between the outer side faces of the first projection and slightly convex between the abutment face and the second side face of said recess, the bowing of the side margin of each element enabling the hinge pip of each side margin of each element to be sprung into the hinge socket of the other side margin of the other element to thereby hingedly connect the polygonal elements together edge-to-edge.

* * * * *